US012364384B2

(12) United States Patent
Drexler et al.

(10) Patent No.: US 12,364,384 B2
(45) Date of Patent: Jul. 22, 2025

(54) DOCKING FILTER FOR A DISHWASHER APPLIANCE

(71) Applicant: Haier US Appliance Solutions, Inc., Wilmington, DE (US)

(72) Inventors: Duwayne Jacob Drexler, Louisville, KY (US); Logan Chayse Dunaway, Greenville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 237 days.

(21) Appl. No.: 18/323,724

(22) Filed: May 25, 2023

(65) Prior Publication Data

US 2024/0389826 A1 Nov. 28, 2024

(51) Int. Cl.
*A47L 15/42* (2006.01)

(52) U.S. Cl.
CPC ..... *A47L 15/4206* (2013.01)

(58) Field of Classification Search
CPC ..... A47L 15/4206
USPC ..... 134/110
See application file for complete search history.

(56) References Cited

U.S. PATENT DOCUMENTS

| | | | |
|---|---|---|---|
| 2,905,092 | A | 9/1959 | Abresch |
| 9,277,848 | B2 | 3/2016 | Yoon et al. |
| 10,893,791 | B2 | 1/2021 | Rappette et al. |
| 2010/0037923 | A1 | 2/2010 | Dingler et al. |

FOREIGN PATENT DOCUMENTS

| | | | |
|---|---|---|---|
| CN | 109998441 A | * | 7/2019 |
| CN | 209733911 U | | 12/2019 |
| KR | 101235929 B1 | | 2/2013 |

OTHER PUBLICATIONS

CN109998441A—machine translation (Year: 2019).*

* cited by examiner

*Primary Examiner* — Tinsae B Ayalew
(74) *Attorney, Agent, or Firm* — Dority & Manning, P.A.

(57) ABSTRACT

A filter assembly for a dishwasher appliance includes a fine filter insertable within a sump of the dishwasher appliance, the fine filter including a fine filter housing and a filter screen attached to the fine filter housing; a filter basket removably coupled to the fine filter, the filter basket defining a peripheral cage and a base cup provided below the peripheral cage, wherein the base cup is selectively sealed with the fine filter housing; a resilient member provided within the base cup of the filter basket, the resilient member being movable between an open position and a closed position; and a drain fitting selectively coupled with the filter basket via the resilient member.

18 Claims, 6 Drawing Sheets

DOCKING FILTER FOR A DISHWASHER APPLIANCE

FIELD OF THE INVENTION

The present subject matter relates generally to dishwasher appliances, and more particularly to filter assemblies for dishwasher appliances.

BACKGROUND OF THE INVENTION

Dishwashing appliances generally include a tub that defines a wash chamber. Rack assemblies can be mounted within the wash chamber of the tub for receipt of articles for washing. Multiple spray assemblies can be positioned within the wash chamber for applying or directing wash liquid (e.g., water, detergent, etc.) towards articles disposed within the rack assemblies in order to clean such articles. After being applied or directed towards the rack assemblies and/or articles therein, the wash liquid generally flows by gravity to or towards a bottom of the wash chamber, such as to a sump positioned at the bottom of the wash chamber. Dishwashing appliances are also typically equipped with one or more pumps, such as a circulation pump or a drain pump, for directing or motivating wash liquid from the sump to, e.g., the spray assemblies or an area outside of the dishwashing appliance.

Certain foreign contaminants, such as food pits, utensil pieces, toothpicks, and the like may be included in the tub during a washing operation. Such contaminants may flow toward the sump where they may be caught within one or more filter materials. However, some such contaminants can bypass the filter materials enter a recirculation pump, a spray arm, or any other functional elements of the dishwasher appliance, causing damage or otherwise downgrading a wash performance of the dishwasher appliance. For instance, during a manual cleaning of some filter elements, the contaminants within the removable filter element may remain within the sump of the dishwasher appliance. Certain water levels within the sump may then carry the contaminants through a recirculation filter and throughout a circulation system of the dishwasher appliance.

Accordingly, a filter assembly that obviates one or more of the above-mentioned drawbacks would be desirable. In particular, a filter assembly that prevents foreign contaminants from entering a recirculation system within a dishwasher appliance would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a filter assembly for a dishwasher appliance is provided. The dishwasher appliance may include a tub and a sump in fluid communication with the sump. The filter assembly may include a fine filter insertable within the sump of the dishwasher appliance, the fine filter including a fine filter housing and a filter screen attached to the fine filter housing; a filter basket removably coupled to the fine filter, the filter basket defining a peripheral cage and a base cup provided below the peripheral cage, wherein the base cup is selectively sealed with the fine filter housing; a resilient member provided within the base cup of the filter basket, the resilient member being movable between an open position and a closed position; and a drain fitting selectively coupled with the filter basket via the resilient member.

In another exemplary aspect of the present disclosure, a dishwasher appliance is provided. The dishwasher appliance may include a tub defining a receiving chamber; a sump provided at a bottom of the tub in fluid communication with the receiving chamber; and a filter assembly removably inserted into the sump. The filter assembly may include a fine filter including a fine filter housing and a filter screen attached to the fine filter housing; a filter basket removably coupled to the fine filter, the filter basket defining a peripheral cage and a base cup provided below the peripheral cage, wherein the base cup is selectively sealed with the fine filter housing; a resilient member provided within the base cup of the filter basket, the resilient member being movable between an open position and a closed position; and a drain fitting selectively coupled with the filter basket via the resilient member, the drain fitting being installed within the sump of the dishwasher appliance.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
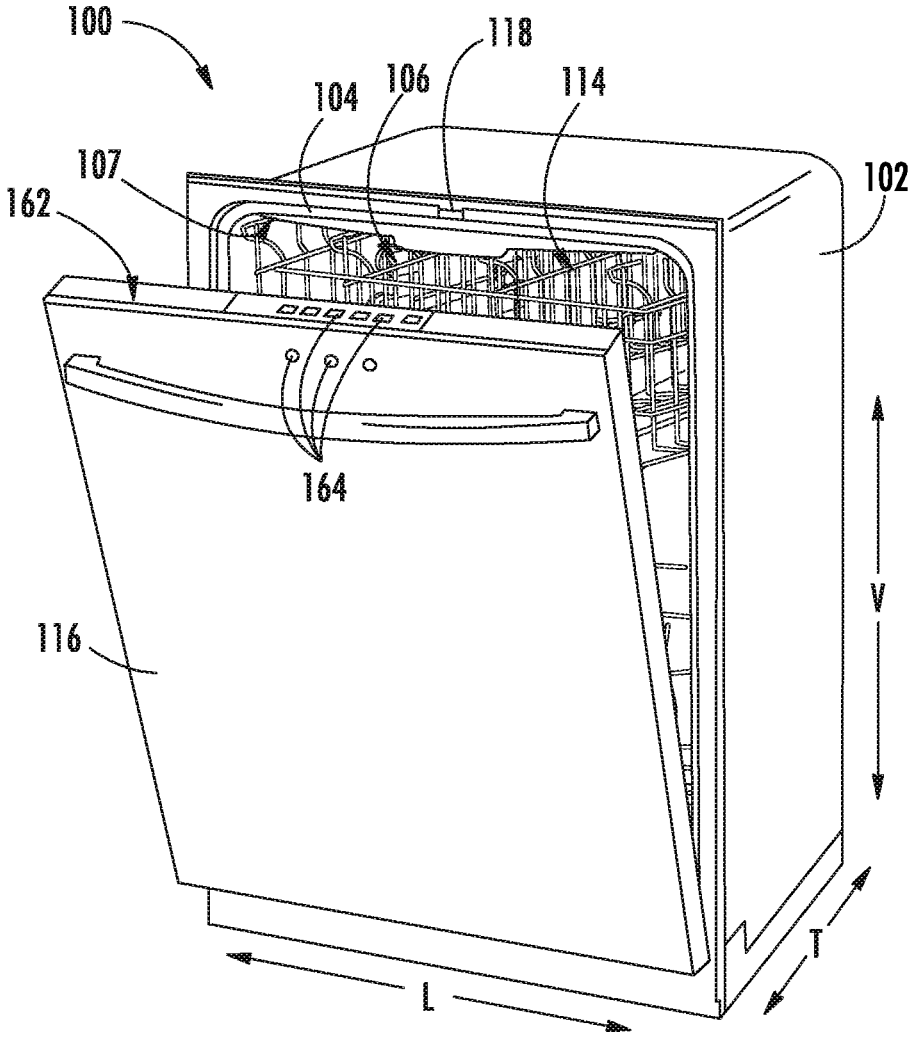
FIG. 1 provides a perspective view of an exemplary embodiment of a dishwashing appliance of the present disclosure with a door in a partially open position.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction. e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

The terms "upstream" and "downstream" refer to the relative flow direction with respect to fluid flow in a fluid pathway. For instance, "upstream" refers to the flow direction from which the fluid flows, and "downstream" refers to the flow direction to which the fluid flows. The term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a wash liquid (e.g., water, detergent, or wash additive). The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash liquid" refers to a liquid used for washing or rinsing the articles that is typically made up of water and may include additives, such as detergent or other treatments (e.g., rinse aid). Furthermore, as used herein, terms of approximation, such as "approximately," "substantially," or "about," refer to being within a ten percent (10%) margin of error.

Figure 2:
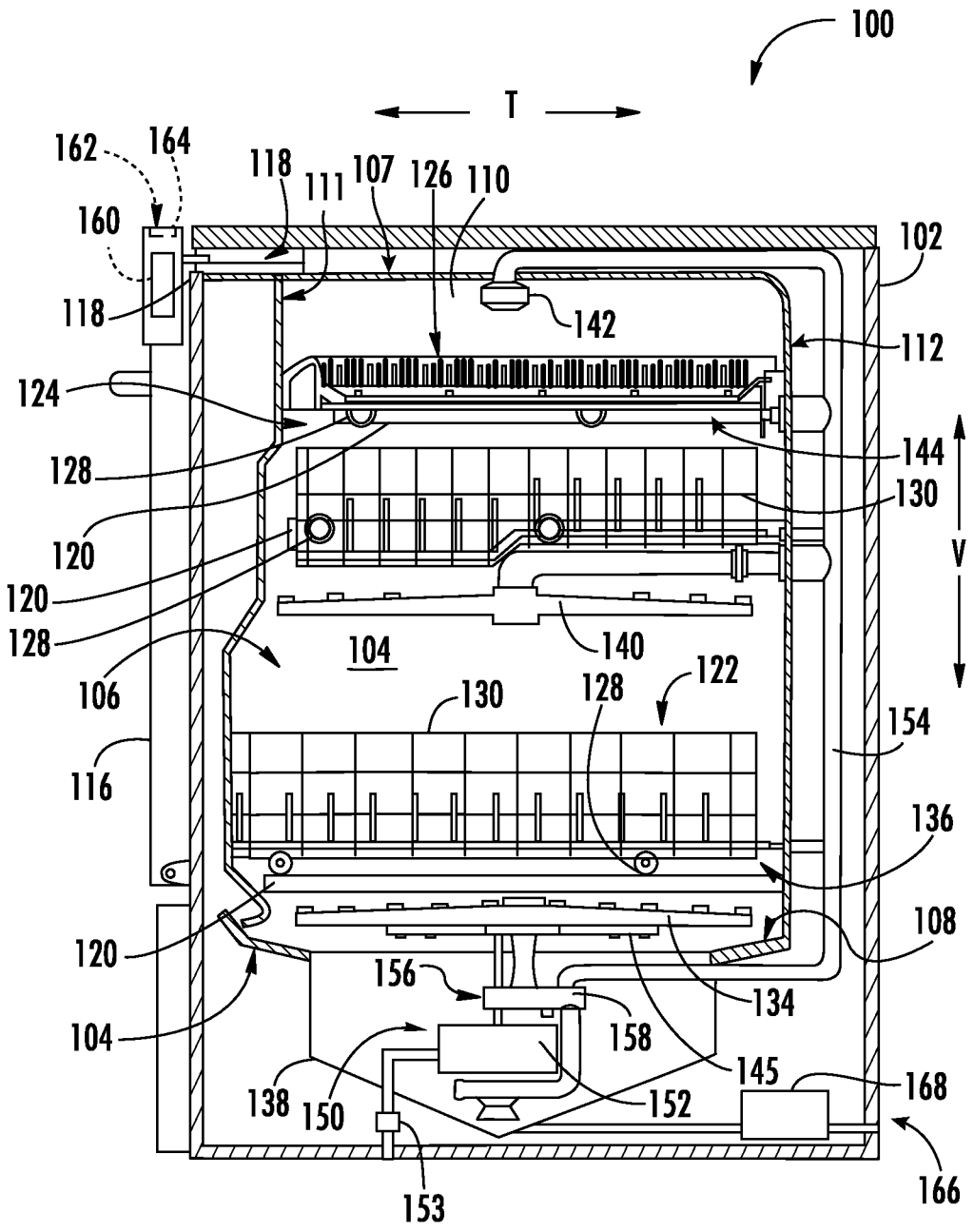
FIG. 2 provides a side, cross-sectional view of the exemplary dishwashing appliance of FIG. 1.

Turning now to the figures, FIGS. 1 and 2 depict an exemplary dishwasher or dishwashing appliance (e.g., dishwashing appliance 100) that may be configured in accordance with aspects of the present disclosure. Generally, dishwasher 100 defines a vertical direction V, a lateral direction L, and a transverse direction T. Each of the vertical direction V, lateral direction L, and transverse direction T are mutually perpendicular to one another and form an orthogonal direction system.

Dishwasher 100 includes a cabinet 102 having a tub 104 therein that defines a wash chamber 106. As shown in FIG. 2, tub 104 extends between a top 107 and a bottom 108 along the vertical direction V, between a pair of side walls 110 along the lateral direction L, and between a front side 111 and a rear side 112 along the transverse direction T.

Tub 104 includes a front opening 114 (FIG. 1). In some embodiments, the dishwasher appliance 100 may also include a door 116 at the front opening 114. The door 116 may, for example, be hinged at its bottom for movement between a normally closed vertical position, wherein the wash chamber 106 is sealed shut for washing operation, and a horizontal open position for loading and unloading of articles from dishwasher 100. A door closure mechanism or assembly 118 may be provided to lock and unlock door 116 for accessing and sealing wash chamber 106.

In exemplary embodiments, tub side walls 110 accommodate a plurality of rack assemblies. For instance, guide rails 120 may be mounted to side walls 110 for supporting a lower rack assembly 122, a middle rack assembly 124, or an upper rack assembly 126. In some such embodiments, upper rack assembly 126 is positioned at a top portion of wash chamber 106 above middle rack assembly 124, which is positioned above lower rack assembly 122 along the vertical direction V.

Generally, each rack assembly 122, 124, 126 may be adapted for movement between an extended loading position (not shown) in which the rack is substantially positioned outside the wash chamber 106, and a retracted position (shown in FIGS. 1 and 2) in which the rack is located inside the wash chamber 106. In some embodiments, movement is facilitated, for instance, by rollers 128 mounted onto rack assemblies 122, 124, 126, respectively. Although guide rails 120 and rollers 128 are illustrated herein as facilitating movement of the respective rack assemblies 122, 124, 126, it should be appreciated that any suitable sliding mechanism or member may be used according to alternative embodiments.

In optional embodiments, some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash liquid to reach and impinge on those articles (e.g., during a cleaning or rinsing cycle). According to additional or alternative embodiments, a silverware basket (not shown) is removably attached to a rack assembly (e.g., lower rack assembly 122), for placement of silverware, utensils, and the like, that are otherwise too small to be accommodated by the rack assembly.

Generally, dishwasher 100 includes one or more spray assemblies for urging a flow of fluid (e.g., wash liquid) onto the articles placed within wash chamber 106. In exemplary embodiments, dishwasher 100 includes a lower spray arm assembly 134 disposed in a lower region 136 of wash chamber 106 and above a sump 138 so as to rotate in relatively close proximity to lower rack assembly 122.

In additional or alternative embodiments, a mid-level spray arm assembly 140 is located in an upper region of wash chamber 106 (e.g., below and in close proximity to middle rack assembly 124). In this regard, mid-level spray arm assembly 140 may generally be configured for urging a flow of wash liquid up through middle rack assembly 124 and upper rack assembly 126.

In further additional or alternative embodiments, an upper spray assembly 142 is located above upper rack assembly 126 along the vertical direction V. In this manner, upper spray assembly 142 may be generally configured for urging or cascading a flow of wash liquid downward over rack assemblies 122, 124, and 126.

In yet further additional or alternative embodiments, upper rack assembly 126 may further define an integral spray manifold 144. As illustrated, integral spray manifold 144 may be directed upward, and thus generally configured for urging a flow of wash liquid substantially upward along the vertical direction V through upper rack assembly 126.

In still further additional or alternative embodiments, a filter clean spray assembly 145 is disposed in a lower region 136 of wash chamber 106 (e.g., below lower spray arm assembly 134) and above a sump 138 so as to rotate in relatively close proximity to a filter assembly 210 (e.g., FIG. 4). For instance, filter clean spray assembly 145 may be directed downward to urge a flow of wash liquid across a portion of filter assembly 210 (FIG. 4) or sump 138.

The various spray assemblies and manifolds described herein may be part of a fluid distribution system or fluid circulation assembly 150 for circulating wash liquid in tub 104. In certain embodiments, fluid circulation assembly 150 includes a circulation pump 152 for circulating wash liquid in tub 104. Circulation pump 152 may be located within sump 138 or within a machinery compartment located below sump 138 of tub 104.

When assembled, circulation pump 152 may be in fluid communication with an external water supply line (not shown) and sump 138. A water inlet valve 153 may be positioned between the external water supply line and circulation pump 152 (e.g., to selectively allow water to flow from the external water supply line to circulation pump 152). Additionally or alternatively, water inlet valve 153 may be positioned between the external water supply line and sump 138 (e.g., to selectively allow water to flow from the external water supply line to sump 138). During use, water inlet valve 153 may be selectively controlled to open to allow the flow of water into dishwasher 100 and may be selectively controlled to close and thereby cease the flow of water into dishwasher 100. Further, fluid circulation assembly 150 may include one or more fluid conduits or circulation piping for directing wash fluid from circulation pump 152 to the various spray assemblies and manifolds. In exemplary embodiments, such as that shown in FIG. 2, a primary supply conduit 154 extends from circulation pump 152, along rear 112 of tub 104 along the vertical direction V to supply wash liquid throughout wash chamber 106.

In some embodiments, primary supply conduit 154 is used to supply wash liquid to one or more spray assemblies (e.g., to mid-level spray arm assembly 140 or upper spray assembly 142). It should be appreciated, however, that according to alternative embodiments, any other suitable plumbing configuration may be used to supply wash liquid throughout the various spray manifolds and assemblies described herein. For instance, according to another exemplary embodiment, primary supply conduit 154 could be used to provide wash liquid to mid-level spray arm assembly 140 and a dedicated secondary supply conduit (not shown) could be utilized to provide wash liquid to upper spray assembly 142. Other plumbing configurations may be used for providing wash liquid to the various spray devices and manifolds at any location within dishwashing appliance 100.

Each spray arm assembly 134 and 140, upper spray assembly 142, integral spray manifold 144, filter clean assembly 145, or other spray device may include an arrangement of discharge ports or orifices for directing wash liquid received from circulation pump 152 onto dishes or other articles located in wash chamber 106. The arrangement of the discharge ports, also referred to as jets, apertures, or orifices, may provide a rotational force by virtue of wash liquid flowing through the discharge ports. Alternatively, spray assemblies 134, 140, 142, 145 may be motor-driven, or may operate using any other suitable drive mechanism. Spray manifolds and assemblies may also be stationary. The resultant movement of the spray assemblies 134, 140, 142, 145 and the spray from fixed manifolds provides coverage of dishes and other dishwasher contents with a washing spray. Other configurations of spray assemblies may be used as well. For instance, dishwasher 100 may have additional spray assemblies for cleaning silverware, for scouring casserole dishes, for spraying pots and pans, for cleaning bottles, etc.

In optional embodiments, circulation pump 152 urges or pumps wash liquid (e.g., from filter assembly 210) to a diverter 156 (FIG. 2). In some such embodiments, diverter 156 is positioned within sump 138 of dishwashing appliance 100). Diverter 156 may include a diverter disk (not shown) disposed within a diverter chamber 158 for selectively distributing the wash liquid to the spray assemblies 134, 140, 142, or other spray manifolds. For instance, the diverter disk may have a plurality of apertures that are configured to align with one or more outlet ports (not shown) at the top of diverter chamber 158. In this manner, the diverter disk may be selectively rotated to provide wash liquid to the desired spray device.

In exemplary embodiments, diverter 156 is configured for selectively distributing the flow of wash liquid from circulation pump 152 to various fluid supply conduits—only some of which are illustrated in FIG. 2 for clarity. In certain embodiments, diverter 156 includes four outlet ports (not shown) for supplying wash liquid to a first conduit for rotating lower spray arm assembly 134, a second conduit for supplying wash liquid to filter clean assembly 145, a third conduit for spraying an auxiliary rack such as the silverware rack, and a fourth conduit for supply mid-level or upper spray assemblies 140, 142 (e.g., primary supply conduit 154).

In some embodiments, an exemplary filter assembly 210 (FIG. 4) is provided. As illustrated for example in FIG. 4, in exemplary embodiments, filter assembly 210 is located (e.g., removably provided) in sump 138, e.g., to filter fluid to circulation assembly 150 and/or drain pump 168. Generally, filter assembly 210 removes soiled particles from the liquid that flows to the sump 138 from the wash chamber 106 during operation of dishwashing appliance 100. In exemplary embodiments, filter assembly 210 includes both a first filter 212 (also referred to as a "coarse filter") and a second filter 214 (also referred to as a "fine filter," described in more detail below).

In some embodiments, the first filter 212 is constructed as a grate having openings for filtering liquid received from wash chamber 106. The sump 138 includes a recessed portion upstream of circulation pump 152 or drain pump 168 and over which the first filter 212 is removably received. In exemplary embodiments, the first filter 212 may be a coarse filter having media openings in the range of about 0.030 inches to about 0.060 inches. The recessed portion of the sump 138 may define a filtered volume wherein debris or particles have been filtered from the wash liquid by the first filter 212 or the second filter 214.

In additional or alternative embodiments, the second filter 214 is provided upstream of circulation pump 152 or drain pump 168. Second filter 214 may be non-removable or, alternatively, may be provided as a removable cartridge positioned in a tub receptacle 216 (FIG. 3) formed in sump 138.

Figure 4:
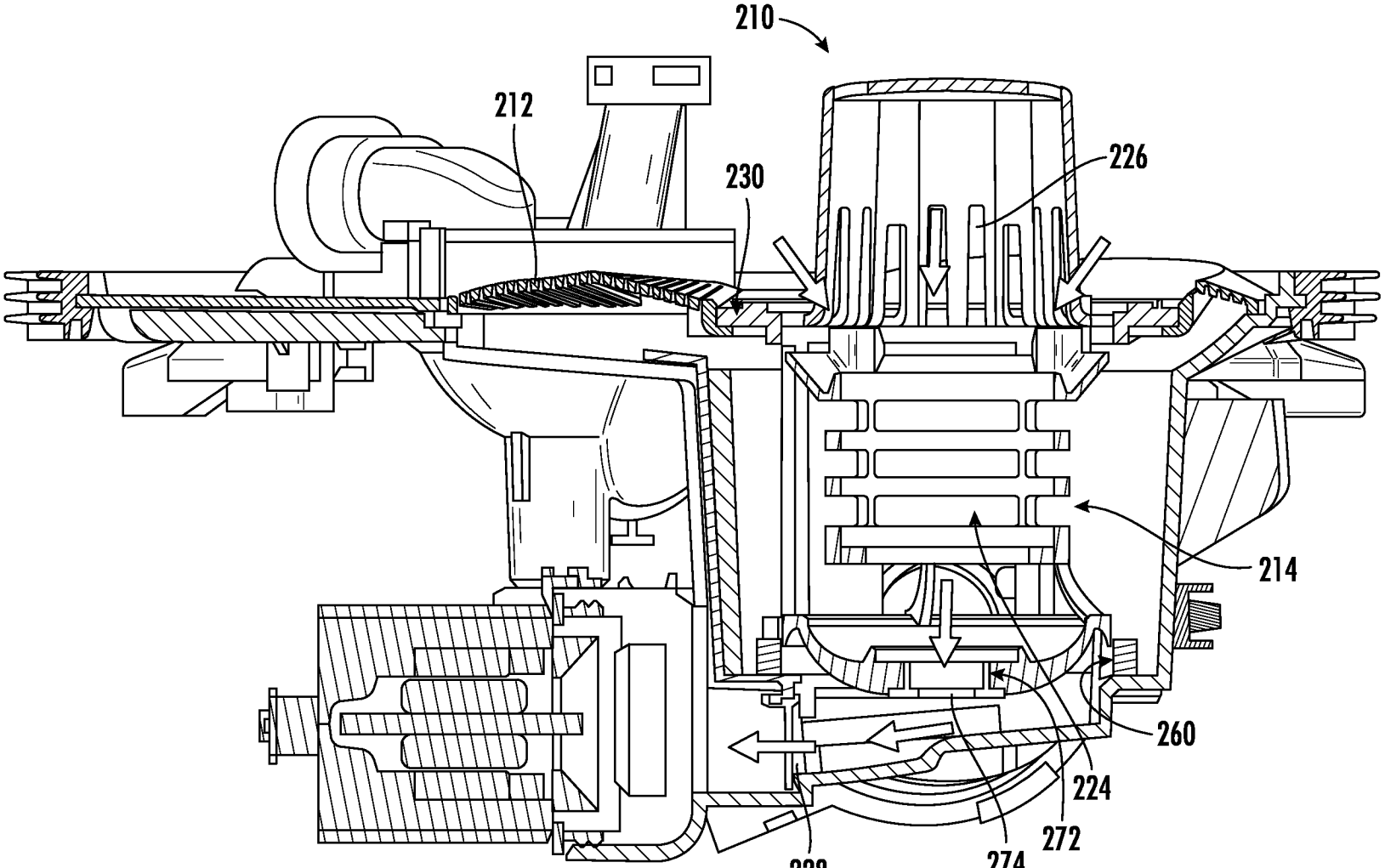
FIG. 4 provides a close up, sectioned view of a sump and a filter assembly of the dishwashing appliance of FIGS. 1 and 2.

For instance, as illustrated in FIG. 4, the second filter 214 may be removably positioned within a collection chamber 218 defined by tub receptacle 216. The second filter 214 may be generally shaped to complement the tub receptacle 216. For instance, the second filter 214 may include a filter wall 220 that complements the shape of the tub receptacle 216. In some embodiments, the filter wall 220 is formed from one or more fine filter media 252. Some such embodiments may include filter media (e.g., screen or mesh, having pore or hole sizes in the range of about 50 microns to about 600 microns).

When assembled, filter wall 220 may have an enclosed (e.g., cylindrical) shape defining an internal chamber 224. In optional embodiments, a top portion of second filter 214 positioned above the internal chamber 224 may define one or more openings 226 (e.g., vertical flow path openings), thereby permitting liquid to flow into the internal chamber 224 without passing through the first filter 212 or the fine filter media of the filter wall 220 of the second filter 214.

Between the top portion openings 226 and drain pump 168, internal chamber 224 may define an unfiltered volume, e.g., when liquid flows through the openings 226 into the internal chamber 224, the liquid is unfiltered in that the liquid did not flow through the filter media of the filter wall 220. A drain outlet 228 may be defined below the top portion openings 226 in fluid communication with internal chamber 224 and drain pump 168 (e.g., downstream of internal chamber 224 or upstream of drain pump 168).

During operation of some embodiments (e.g., during or as part of a wash cycle or rinse cycle), circulation pump 152 draws wash liquid in from sump 138 through filter assembly 210 (e.g., through first filter 212 or second filter 214). Thus, circulation pump 152 may be downstream of filter assembly 210.

Drainage of soiled wash liquid within sump 138 may occur, for instance, through drain assembly 166 (e.g., during or as part of a drain cycle). In particular, wash liquid may exit sump 138 through the drain outlet 228 and may flow through a drain conduit. In some embodiments, a drain pump 168 downstream of sump 138 facilitates drainage of the soiled wash liquid by urging or pumping the wash liquid to a drain line external to dishwasher 100. Drain pump 168 may be downstream of first filter 212 or second filter 214. Additionally or alternatively, an unfiltered flow path may be defined through sump 138 to drain conduit such that an unfiltered fluid flow may pass through sump 138 to drain conduit without first passing through filtration media of either first filter 212 or second filter 214.

For example, the unfiltered flow path may extend through the openings 226, whereby liquid may flow from a filter spillway 230 and into the internal chamber 224 from the top of the internal chamber 224, e.g., without passing through the wall 220 of the fine filter 214. Such unfiltered flow path may be available so long as a maximum height of liquid in the sump 138 is above the filter spillway 230, which may occur during a first portion of the drain cycle.

During, for example, a second portion of the drain cycle, when the maximum liquid height is below the filter spillway 230, at least a portion of wash liquid within sump 138 may generally pass into internal chamber 224 through second filter 214, e.g., through filter wall 220, before flowing through drain assembly 166 and from dishwashing appliance 100. The second portion of the drain cycle may occur when the liquid level within sump 138 has been drawn below the filter spillway 230, whereby liquid can no longer bypass the filter wall 220 of second filter 214 via the openings 226. Although a separate recirculation pump 152 and drain pump 168 are described herein, it is understood that other suitable pump configurations (e.g., using only a single pump for both recirculation and draining) may be provided.

In certain embodiments, dishwasher 100 includes a controller 160 configured to regulate operation of dishwasher 100 (e.g., initiate one or more wash operations). Controller 160 may include one or more memory devices and one or more microprocessors, such as general or special purpose microprocessors operable to execute programming instructions or micro-control code associated with a wash operation that may include a wash cycle, rinse cycle, or drain cycle. The memory may represent random access memory such as DRAM, or read only memory such as ROM or FLASH. In some embodiments, the processor executes programming instructions stored in memory. The memory may be a separate component from the processor or may be included onboard within the processor. Alternatively, controller 160 may be constructed without using a microprocessor, e.g., using a combination of discrete analog or digital logic circuitry—such as switches, amplifiers, integrators, comparators, flip-flops, AND gates, and the like—to perform control functionality instead of relying upon software. It should be noted that controllers as disclosed herein are capable of and may be operable to perform any methods and associated method steps as disclosed herein.

Controller 160 may be positioned in a variety of locations throughout dishwasher 100. In optional embodiments, controller 160 is located within a control panel area 162 of door 116 (e.g., as shown in FIGS. 1 and 2). Input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of dishwasher 100. In some embodiments, user interface 164 includes a general purpose I/O ("GPIO") device or functional block. In additional or alternative embodiments, user interface 164 includes input components, such as one or more of a variety of electrical, mechanical or electromechanical input devices including rotary dials, push buttons, and touch pads. In further additional or alternative embodiments, user interface 164 includes a display component, such as a digital or analog display device designed to provide operational feedback to a user. When assembled, user interface 164 may be in operative communication with the controller 160 via one or more signal lines or shared communication busses.

Figure 3:
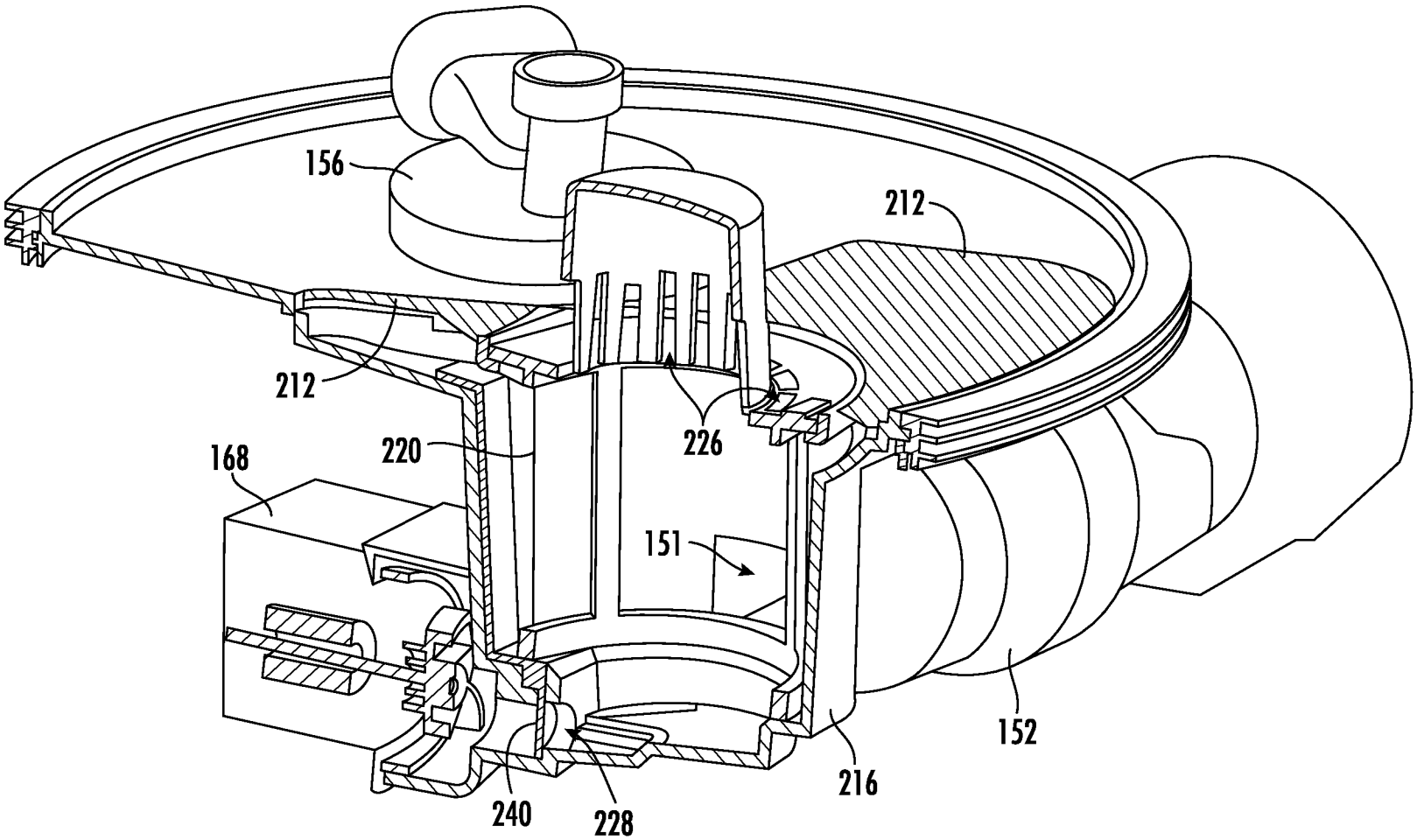
FIG. 3 provides a sectioned perspective view of the sump of the dishwashing appliance of FIGS. 1 and 2.

Turning now to FIG. 3, a sectioned perspective view of the sump is provided, with the section in this view being taken through drain pump 168 and a check valve 240 upstream of drain pump 168. Check valve 240 is upstream of the drain pump 168 in that check valve 240 is, e.g., between sump 138 and drain pump 168, such as between collection chamber 218 and drain pump 168, where collection chamber 218 is defined within sump 138 by tub receptacle 216. Also seen in FIG. 3 is a recirculation inlet 151 which leads from collection chamber 218 to the recirculation pump 152. In some embodiments, dishwasher 100 may include a backflow preventer or check valve 240 (FIG. 3), e.g., a one-way valve, positioned at drain outlet 228. Check valve 240 may be positioned and oriented such that check valve 240 permits liquid flow from sump 138 to drain assembly 166 and restricts or prevents liquid flow to sump 138 from drain assembly 166.

It should be appreciated that the invention is not limited to any particular style, model, or configuration of dishwasher 100. The exemplary embodiments depicted in FIGS. 1 through 3 are for illustrative purposes only. For instance, different locations may be provided for user interface 164, different configurations may be provided for rack assemblies 122, 124, 126, different spray assemblies 134, 140, 142 and spray manifold configurations may be used, different sensors may be used, such as an optical level sensor which may, in some embodiments, also be configured to measure turbidity, and other differences may be applied while remaining within the scope of the present disclosure.

FIG. 4 provides a close-up, cross-sectional view of sump 138 and filter assembly 210 inserted therein, including drain outlet 228. As mentioned above, filter assembly 210 may include first filter 212 and second filter 214. Hereinafter, second filter (e.g., fine filter) 214 will be described in detail. Filter assembly 210 (e.g., fine filter 214) may define an axial direction A, a radial direction R, and a circumferential direction C. According to at least some embodiments, axial direction A corresponds with (e.g., is parallel with) vertical direction V of dishwasher appliance 100).

Figure 5:
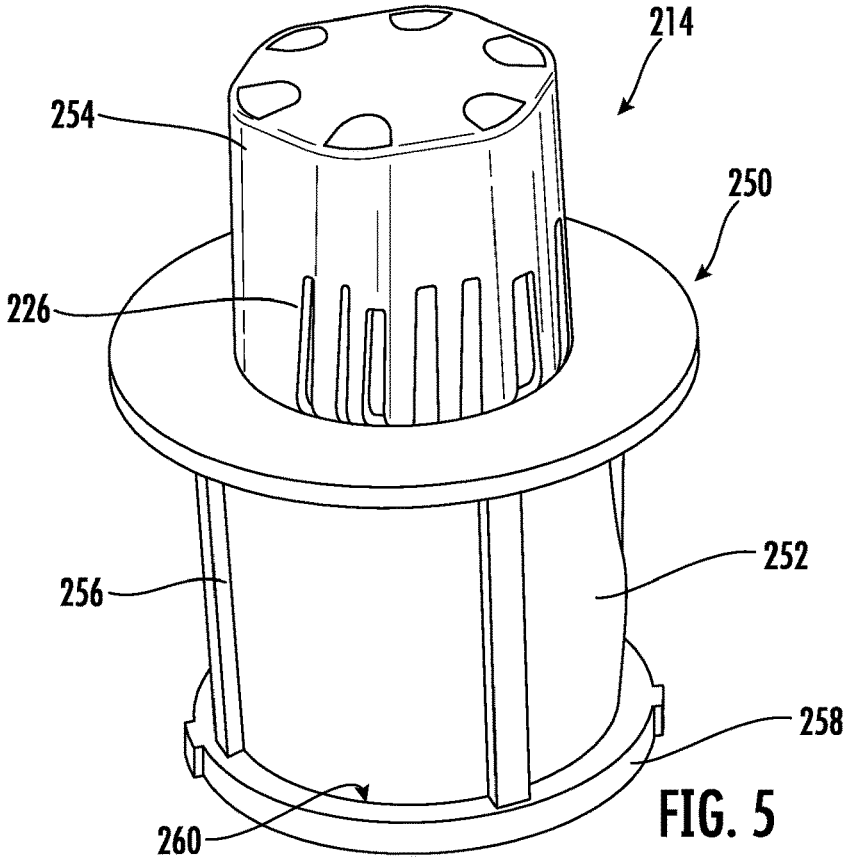
FIG. 5 provides a perspective view of a fine filter of the exemplary filter assembly of FIG. 4.

Fine filter 214 may include a fine filter housing 250 and a filter screen (e.g., fine filter media) 252. As shown also in FIG. 5, fine filter housing 250 may include cap (e.g., top portion) 254, a plurality of supports 256, and a base ring 258. Filter screen 252 may be supported by the plurality of supports 256 (e.g., along the circumferential direction C) and may extend axially between cap 254 and base ring 258. Filter screen 252 may be a mesh filter screen. For instance, filter screen 252 may be formed of a porous material through which liquid water may flow. In some embodiments, filter screen 252 is a netting or metallic screen including a plurality of apertures. Accordingly, liquid (e.g., water) may flow through filter screen 252 while larger contaminants are restrained from flowing therethrough.

As mentioned above, top portion openings 226 may be formed in cap 254. Accordingly, water from wash chamber 106 may flow into fine filter 214 (e.g., internal chamber 224) via openings 226. The water may then flow or seep through filter screen 252 (e.g., outward along the radial direction R) into sump 138. Some water (e.g., water with large contaminants) may remain within internal chamber 224). As will be described below, the remaining unfiltered water and contaminants may be directed toward drain outlet 228. The plurality of supports 256 may extend along the axial direction A (e.g., the vertical direction V) between cap 254 and base ring 258. In some embodiments, the plurality of supports 256 extend at acute non-zero angles between cap 254 and base ring 258 (e.g., in a crisscross pattern defined about the circumferential direction C). As would be understood, the plurality of supports may have any suitable shape, size, or amount, and the disclosure is not limited to the examples given herein.

Base ring 258 may be defined at or near a bottom of fine filter housing 250 (e.g., along the axial direction A or vertical direction V). Base ring 258 may be rigid so as to support the plurality of supports 256. Base ring 258 may be predominantly circular (e.g., about the circumferential direction C) to form a bottom opening into fine filter housing 250 or internal chamber 224. Accordingly, base ring 258 may define an inner outlet surface 260. Inner outlet surface 260 may face inward along the radial direction R toward internal chamber 224 of fine filter housing 250. Additionally or alternatively, base ring 258 may selectively rest on a bottom of sump 138 (e.g., when fine filter 214 is in an inserted position within sump 138).

Figure 6:
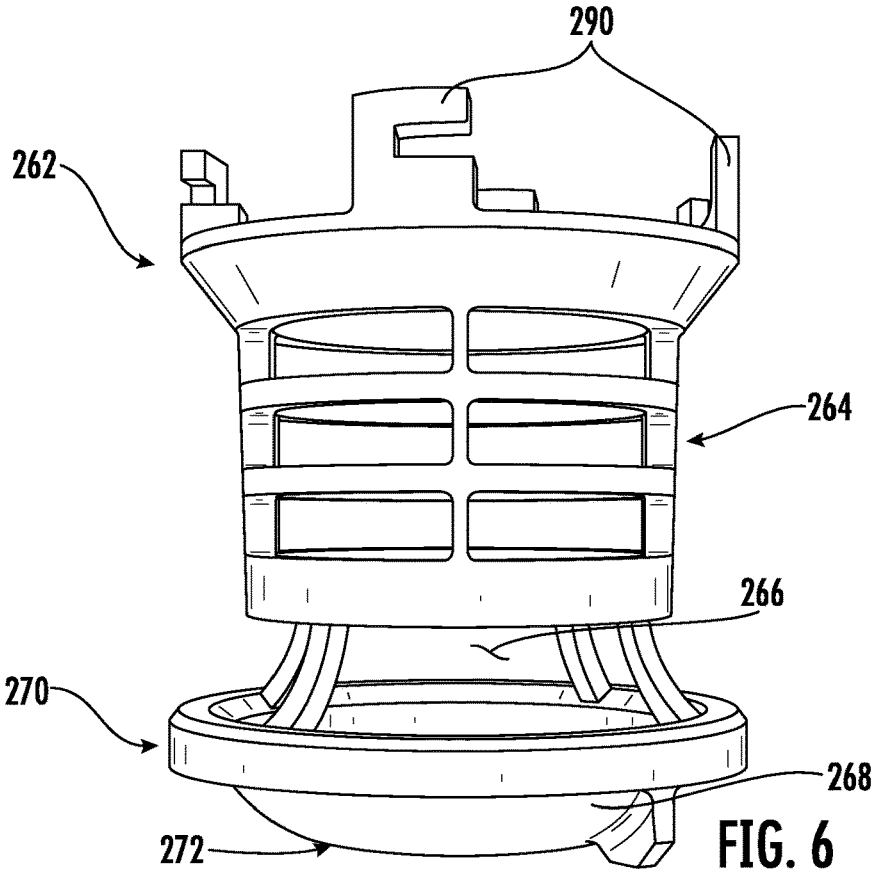
FIG. 6 provides a perspective view of a filter basket of the exemplary filter assembly of FIG. 4.
Figure 7:
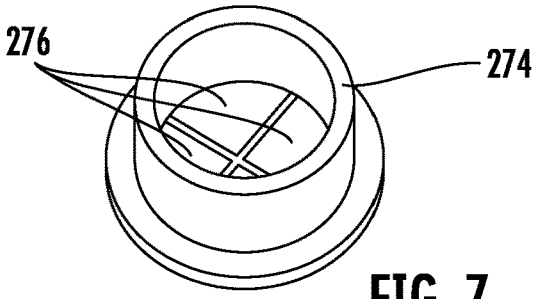
FIG. 7 provides a perspective view of a grommet of the exemplary filter assembly of FIG. 4.
Figure 8:
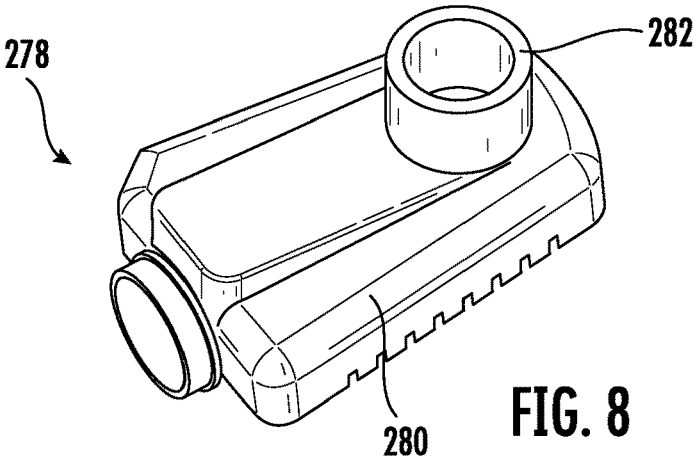
FIG. 8 provides a perspective view of a drain fitting of the exemplary filter assembly of FIG. 4.

Fine filter 214 may include a filter basket 262. As shown in FIGS. 4 and 6, filter basket 262 may be selectively inserted within fine filter housing 250. In detail, filter basket 262 may be inserted within internal chamber 224 of fine filter housing 250. Thus, filter basket 262 may be positioned inward from filter screen 252 (e.g., along the radial direction R). Filter basket 262 may include a peripheral cage 264. Peripheral cage 264 may extend about the circumferential direction C. Peripheral cage 264 may include one or more rigid struts configured to capture large contaminants therein (e.g., from unfiltered water provided to fine filter 214). Accordingly, peripheral cage 264 may form a cage chamber 266. Cage chamber 266 may be defined within internal chamber 224 (e.g., within fine filter 214).

Filter basket 262 may include one or more latch members 290. The one or more latch members 290 may extend from a top ring of peripheral cage 264 (e.g., along the axial direction A), for instance. The one or more latch members 290 may selectively connect filter basket 262 to fine filter housing 250 (e.g., at an internal surface thereof). Thus, the one or more latch members 290 may form a hook shape extending along the circumferential direction C. Thus, when filter basket 262 is inserted into fine filter housing 250 and twisted (e.g., about the circumferential direction C), filter basket 262 may be latched to fine filter housing 250.

Filter basket 262 may include a base cup 268. Base cup 268 may be provided at a bottom of filter basket 262 (e.g., along the axial direction A or vertical direction V). Base cup 268 may thus form a bottom of filter basket 262. For instance, base cup 268 may be provided below peripheral cage 264. Base cup 268 may be formed of a non-porous material such as to restrict water and contaminants from flowing out of fine filter 214. Base cup 268 may be generally concave shaped (e.g., downward along the axial direction A), forming a bowl at the bottom of filter basket 262. Base cup 268 may be attached to peripheral cage 264 via one or more struts. However, it should be noted that the connection type or method of base cup 268 to peripheral cage 264 may vary according to specific embodiments, and the disclosure is not limited to the examples given herein.

Figure 9:
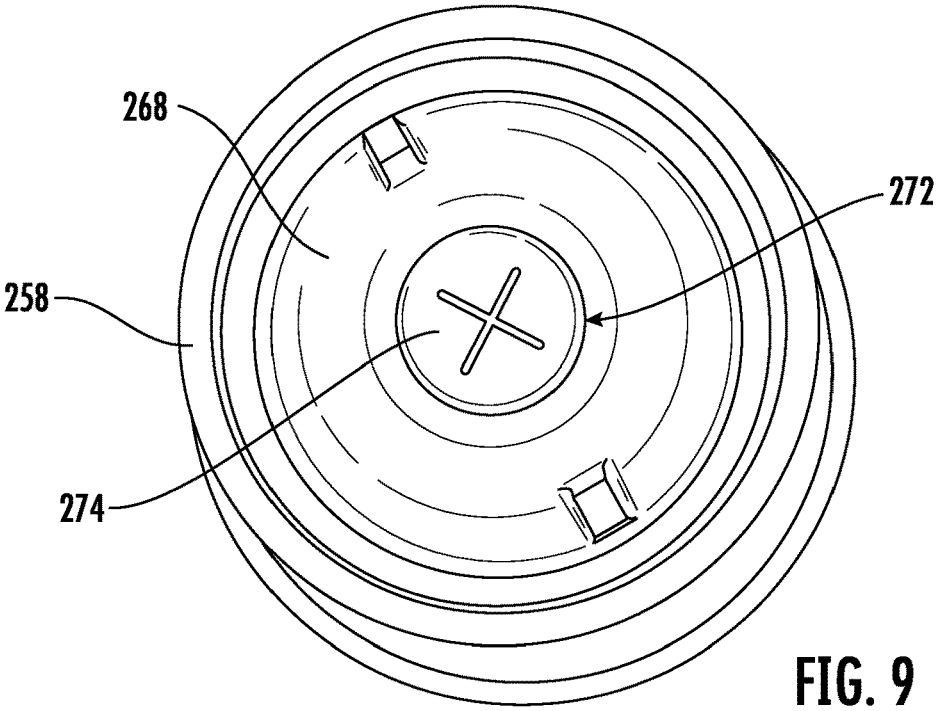
FIG. 9 provides a bottom view of the exemplary filter assembly of FIG. 4 including the grommet in a closed position.

Filter basket 262 (e.g., base cup 268) may define an outer base cup surface 270. For instance, outer base cup surface 270 may be defined on an outward surface (e.g., along the radial direction R) of base cup 268. Additionally or alternatively, outer base cup surface 270 may extend about the circumferential direction C of base cup 268. According to some embodiments, outer base cup surface 270 may include a gasket (e.g., a malleable ring) attached thereto. Additionally or alternatively, outer base cup surface 270 may be beveled (e.g., angled inward along the radial direction R). Thus, as can be seen in FIGS. 4 and 9, outer base cup surface 270 may contact inner outlet surface 260 when filter basket 262 is inserted into fine filter housing 250.

In detail, base ring 258 of fine filter housing 250 may have or define a base diameter D1. Similarly, base cup 268 may define a cup diameter D2. According to at least some embodiments, base diameter D1 is approximately equal to cup diameter D2. According to this description, base diameter D1 may be within an engineering tolerance of cup diameter D2. Base diameter D1 may be slightly larger (e.g., 0.1%, 0.01%) than cup diameter D2 such that base cup 268 does not directly interfere with fine filter housing 250 upon insertion thereto. In some embodiments (e.g., including the gasket around base cup 268), an interference fit is established to provide a seal (e.g., a water-tight seal) between base cup 268 of filter basket 262 and fine filter housing 250. Advantageously, contaminants captured within fine filter housing 250 (e.g., within internal chamber 224 or cage chamber 266) are prohibited from being released into sump 138 when fine filter 214 is removed from sump 138 (e.g., during a manual cleaning). This may prevent large contaminants from entering the recirculation system of appliance 100.

Base cup 268 may further include a drain hole 272. Drain hole 272 may be formed at a bottom of base cup 268. Drain hole 272 may be centrally located within the bottom of base cup 268 (e.g., centered about the radial direction R). Drain hole 272 may have a predetermined diameter to allow drain water and smaller contaminants to pass therethrough. For instance, the diameter of drain hole 272 may be between about 45% and about 55% of cup diameter D2.

A resilient member 274 may be attached to base cup 268. In detail, resilient member 274 may be positioned within drain hole 272. Resilient member 274 may selectively open and close drain hole 272. For instance, resilient member 274 maya be movable between an open position (e.g., as shown in FIG. 4) and a closed position (e.g., as shown in FIG. 9). Accordingly, resilient member 274 may define a plurality of flaps 276. The plurality of flaps 276 may extend inward along the radial direction R (e.g., when resilient member 274 is in the closed position). Accordingly, each of the plurality of flaps 276 may be deflected when resilient member 274 is moved to the open position, allowing fluid communication between internal chamber 224 (or cage chamber 266) and drain outlet 228. According to at least some embodiments, resilient member 274 is a grommet. It should be noted that any suitable resilient member may be incorporated according to specific embodiments, however, including a spring loaded plunger, a spring loaded door, an articulating hinge, or the like, and the disclosure is not limited to the examples described herein.

Filter assembly 210 may include a drain fitting 278. Drain fitting 278 may be attached within sump 138, for instance. Drain fitting 278 may provide a fluid passageway from internal chamber 224 of fine filter 214 to drain outlet 228. Drain fitting 278 may include a body 280 and a tube 282 extending from body 280. In detail, tube 282 may extend from body 280 along the vertical direction V (e.g., along the axial direction A). Tube 282 may be selectively coupled with filter basket 262. For instance, tube 282 may be selectively inserted through drain hole 272 (e.g., via resilient member 274). Tube 282 may thus selectively move resilient member 274 from the closed position to the open position. For at least one example, when fine filter 214 is inserted into sump 138, tube 282 penetrates resilient member 274 to allow fluid communication from internal chamber 224 to drain outlet 228.

A diameter of tube 282 may thus be commensurate with the diameter of drain hole 272. For instance, the diameter of tube 282 may be between about 10% and about 20% smaller than the diameter of drain hole 272. Accordingly, resilient member 274 may be sufficiently opened when tube 282 is inserted therein, allowing for proper and adequate drainage during operation of appliance 100. As described above, because base cup 268 is selectively and effectively sealed with fine filter housing 250 and resilient member 274 moves to the closed position when removed from tube 282 of drain fitting 278, contaminants caught within internal chamber 224 (or cage chamber 266) are captured within fine filter 214. Accordingly, large, potentially damaging contaminants and objects are restricted from entering the recirculation system of appliance 100.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A filter assembly for a dishwasher appliance, the dishwasher appliance comprising a tub and a sump in fluid communication with the sump, the filter assembly comprising:

a fine filter insertable within the sump of the dishwasher appliance, the fine filter comprising a fine filter housing and a filter screen attached to the fine filter housing;

a filter basket removably coupled to the fine filter, the filter basket defining a peripheral cage and a base cup provided below the peripheral cage, wherein the base cup is selectively sealed with the fine filter housing;

a member provided within the base cup of the filter basket, the member being movable between an open position and a closed position; and a drain fitting selectively coupled with the filter basket via the member.

2. The filter assembly of claim 1, wherein the filter assembly defines an axial direction, a radial direction, and a circumferential direction, the member being provided along the axial direction at a bottom of the base cup.

3. The filter assembly of claim 2, wherein the drain fitting comprises a tube selectively inserted through the member to move the member from the closed position to the open position.

4. The filter assembly of claim 2, wherein the member is a grommet comprising a plurality of flaps extending radially inward in the closed position.

5. The filter assembly of claim 2, wherein the filter screen is provided around the fine filter housing along the circumferential direction.

6. The filter assembly of claim 5, wherein the filter basket is selectively inserted to an inserted position within the fine filter housing inward from the filter screen along the radial direction.

7. The filter assembly of claim 6, wherein the fine filter housing defines an inner outlet surface, wherein the filter basket defines an outer base cup surface, and wherein the inner outlet surface of the fine filter housing selectively contacts the outer base cup surface in the inserted position.

8. The filter assembly of claim 2, wherein the filter basket comprises:

at least one latch member extending from the peripheral cage along the axial direction, the at least one latch member selectively coupling the filter basket to the fine filter housing.

9. A dishwasher appliance defining a vertical direction, a lateral direction, and a transverse direction, the dishwasher appliance comprising:

a tub defining a receiving chamber;

a sump provided at a bottom of the tub in fluid communication with the receiving chamber; and a filter assembly removably inserted into the sump, the filter assembly comprising:

a fine filter comprising a fine filter housing and a filter screen attached to the fine filter housing;

a filter basket removably coupled to the fine filter, the filter basket defining a peripheral cage and a base cup provided below the peripheral cage, wherein the base cup is selectively sealed with the fine filter housing;

a member provided within the base cup of the filter basket, the member being movable between an open position and a closed position; and a drain fitting selectively coupled with the filter basket via the member, the drain fitting being installed within the sump of the dishwasher appliance.

10. The dishwasher appliance of claim 9, wherein the sump defines a drain outlet and a recirculation outlet, the recirculation outlet provided above the drain outlet along the vertical direction.

11. The dishwasher appliance of claim 10, wherein the drain fitting provides a fluid connection between the filter assembly and the drain outlet.

12. The dishwasher appliance of claim 11, wherein the filter assembly defines an axial direction, a radial direction, and a circumferential direction, the member being provided along the axial direction at a bottom of the base cup.

13. The dishwasher appliance of claim 12, wherein the drain fitting comprises a tube selectively inserted through the member to move the member from the closed position to the open position.

14. The dishwasher appliance of claim 12, wherein the member is a grommet comprising a plurality of flaps extending radially inward in the closed position.

15. The dishwasher appliance of claim 12, wherein the filter screen is provided around the fine filter housing along the circumferential direction.

16. The dishwasher appliance of claim 15, wherein the filter basket is selectively inserted to an inserted position within the fine filter housing inward from the filter screen along the radial direction.

17. The dishwasher appliance of claim 16, wherein the fine filter housing defines an inner outlet surface, wherein the filter basket defines an outer base cup surface, and wherein the inner outlet surface of the fine filter housing selectively contacts the outer base cup surface in the inserted position.

18. The dishwasher appliance of claim 12, wherein the filter basket comprises:

at least one latch member extending from the peripheral cage along the axial direction, the at least one latch member selectively coupling the filter basket to the fine filter housing.

* * * * *